US006246847B1

(12) United States Patent
Jeong et al.

(10) Patent No.: US 6,246,847 B1
(45) Date of Patent: Jun. 12, 2001

(54) ELECTRONIC PHOTOGRAPH FORMING APPARATUS AND METHOD FOR CONTROLLING THE SAME

(75) Inventors: Su-Jong Jeong; Tai-Eun Kwon; Sung-Gi Kim, all of Kumi-shi (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/505,725

(22) Filed: Feb. 17, 2000

(30) Foreign Application Priority Data

Feb. 19, 1999 (KR) ..... 99-5522

(51) Int. Cl.[7] ..... G03G 15/00; G03G 15/16; G03G 21/00

(52) U.S. Cl. ..... 399/101; 399/66; 399/149; 399/296; 399/343

(58) Field of Search ..... 399/149, 150, 399/101, 45, 66, 296, 343; 430/125, 126

(56) References Cited

U.S. PATENT DOCUMENTS 5,386,274 * 1/1995 Sanpe et al. ..... 399/101
5,839,026 * 11/1998 Ko ..... 399/100
5,903,798 * 5/1999 Yokogawa et al. ..... 399/66
5,970,279 * 10/1999 Sakaizawa et al. ..... 399/149 X
5,970,302 * 10/1999 Yamane ..... 399/343
6,026,267 * 2/2000 Kimura ..... 399/296

* cited by examiner

*Primary Examiner*—Sophia S. Chen
(74) *Attorney, Agent, or Firm*—Robert E. Bushnell, Esq.

(57) ABSTRACT

Disclosed is an electronic photograph forming apparatus including a supplying roller, a developing roller, a charging roller, a laser scanning unit (LSU), a transferring roller, an organic photoconductive (OPC) drum, a pre-transfer lamp (PTL), a controller, and a power supply. The organic photoconductive drum is charged by the charging roller. An electrostatic latent image is formed on the organic photoconductive drum by the laser scanning unit, and the electrostatic latent image is changed into a visible image by toner supplied from the developing roller. The pre-transfer lamp reduces the attached force of toner attached to the organic photoconductive drum to a predetermined level. The controller varies the voltage of the transferring roller according to a predetermined standard so that toner remaining on the transferring roller is transferred to the organic photoconductive drum while the organic photoconductive drum and the transferring roller are raced. The power supply supplies above components with power and forms a potential difference to collect the toner remaining on the organic photoconductive drum and having negative charges by the developing roller.

26 Claims, 8 Drawing Sheets

FIG. 8

| Resistance between transferring roller and OPC drum | Voltage removing toner having positive charges |
|---|---|
| Less than90MΩ | 500V |
| 110MΩ | 600V |
| 125MΩ | 700V |
| 150MΩ | 900V |
| 200MΩ | 1100V |
| 250MΩ | 1300V |
| 300MΩ | 1500V |
| 400MΩ | 1700V |
| 500MΩ | 1850V |
| 700MΩ | 1900V |
| More than800MΩ | 1900V |

FIG. 9A

| Composite resistance | Transferring voltage |
|---|---|
| R<80MΩ | 600V |
| 80MΩ≤R<90MΩ | 700V |
| 90MΩ≤R<100MΩ | 800V |
| 100MΩ≤ R<110MΩ | 900V |
| 110MΩ≤ R<120MΩ | 1000V |
| 120MΩ≤ R<130MΩ | 1100V |
| 130MΩ≤ R<140MΩ | 1200V |
| 140MΩ≤ R<150MΩ | 1300V |
| 150MΩ≤ R<160MΩ | 1400V |
| 160MΩ≤ R<170MΩ | 1500V |
| 170MΩ≤ R<180MΩ | 1600V |

FIG. 9B

| Composite resistance | Transferring voltage |
|---|---|
| R<200MΩ | 1000V |
| 200MΩ≦R<225MΩ | 1100V |
| 225MΩ≦R<250MΩ | 1200V |
| 250MΩ≦R<275MΩ | 1300V |
| . | . |
| . | . |
| . | . |
| . | . |
| . | . |
| . | . |
| 400MΩ≦R<500MΩ | 1900V |

FIG. 9C

| Composite resistance | Transferring voltage |
|---|---|
| R<400MΩ | 1600V |
| 400MΩ≦R<450MΩ | 1700V |
| 450MΩ≦R<500MΩ | 1800V |
| 500MΩ≦R<550MΩ | 1900V |
| . | . |
| . | . |
| . | . |
| . | . |
| . | . |
| . | . |
| 1000MΩ≦R | 2900V |

ELECTRONIC PHOTOGRAPH FORMING APPARATUS AND METHOD FOR CONTROLLING THE SAME

CLAIM OF PRIORITY

This application makes reference to, incorporates the same herein, and claims all benefits accruing under 35 U.S.C. § 119 from an application entitled Electronic Photograph Forming Apparatus And Method For Controlling The Same earlier filed in the Korean Industrial Property Office on the Feb. 19, 1999, and there duly assigned Serial No. 99-5522, a copy of which is annexed hereto.

BACKGROUND OF THE INVENTION

1. Technical Field

This invention relates to an electronic photograph forming apparatus and a method for controlling the apparatus. More specifically, the present invention relates to an electronic photograph forming apparatus which is capable of entirely removing waste toner without using a waste toner removing unit and a method for controlling the same.

2. Related Art

A printer is an image formation device which receives data and then forms an image corresponding to the data on a recordable medium such as a sheet of paper.

In a laser printer, print data can be received from external equipment such as a host computer or a personal computer in order to develop the print data into printable image data. The developed image data are stored in a print image buffer. Then a laser beam, corresponding to image data of one raster read out from the print image buffer, is emitted from a laser diode to perform a main scanning operation, thereby forming an electrostatic latent image on a photosensitive drum for every dot line. Thereafter, toner is attached to the electrostatic latent image on the photosensitive drum and then transferred onto a recordable medium such as a sheet of paper. The toner on the recordable medium is heated by a fixing heater of a fixing device to fix the toner on the recordable medium, thereby completing a print process. Laser printers are also referred to as electrophotographic printers. The aforementioned photosensitive drum can correspond to a photoconductive drum or an organic photoconductive drum.

I have found that toner can often remain on various drums of a laser printer, which will contaminate those various drums. This contamination requires that a waste-toner removing unit be installed in the laser printer to prevent or reduce the contamination.

SUMMARY OF THE INVENTION

It is an object of the present invention to entirely remove waste toner without using a waste toner removing unit.

It is another object of the present invention to increase transferring efficiency and obtain a high quality image by varying the surface potential of the organic photoconductive drum before toner developed on the organic photoconductive drum enters a transferring portion.

It is another object of the present invention to increase transferring efficiency even though a small capacity of power supply is used by varying the voltage supplied to the transferring roller according to the resistance of the print paper.

It is still another object of the present invention to suppress waste toner generation and obtain a high quality image by using the space where the transferring roller and the organic photoconductive drum are raced as the space for cleaning the transferring roller and the organic photoconductive drum.

It is another object of the present invention to prevent toner from being attached to the organic photoconductive drum by the mechanical friction between the charging roller and the organic photoconductive drum.

It is another object of the present invention to efficiently collect the remaining toner by appropriately adjusting the potential difference between a charging voltage and a developing voltage.

According to an aspect of the present invention to achieve the objects and other objects, an electronic photograph forming apparatus including a supplying roller, a developing roller, a charging roller, a laser scanning unit (LSU), a transferring roller and a power supply is provided. An organic photoconductive drum is charged by the charging roller. By the laser scanning unit, an electrostatic latent image is formed. Then, toner is transferred from the developing roller to form a visible image on the organic photoconductive drum. At this time, the attached force of the toner is reduced to a predetermined level through a pre-transfer lamp. Then, the toner attached to the organic photoconductive drum is transferred onto a print paper by the transferring roller. Thereafter, the toner transferred paper is transferred to a fixing unit. On the other hand, in order to collect waste toner attached to the transferring roller onto the organic photoconductive drum before and behind an image printing space while the organic photoconductive drum and the transferring roller are raced, the voltage of the transferring roller is varied by a controller according to a predetermined standard, and toner having negative charges and existing in a non-image portion of the organic photoconductive drum is collected onto the developing roller by the potential difference.

Preferably, according to the predetermined standard, a lower voltage than the voltage supplied to the organic photoconductive drum is supplied to the transferring roller so that the toner attached to the transferring roller and having negative charges is transferred to the organic photoconductive drum, and a higher voltage than the voltage supplied to the organic photoconductive drum is supplied to the transferring roller so that the toner attached to the transferring roller and having positive charges is transferred to the organic photoconductive drum.

Preferably, the controller varies the voltage of the transferring roller according to the resistance of the print paper entering the transferring roller. According to the present invention, a blade for evenly spreading the toner supplied to the developing roller is further included. At this time, the voltages supplied to the blade and the supplying roller are the same, whereby an evenly coated toner layer can be obtained.

Preferably, the speeds of the charging roller and the organic photoconductive drum is structured in the ratio of one to one. Preferably, the toner is one of pulverization type toner and polymerization type toner.

According to the present invention, the pre-transfer lamp supplies the entire surface of the organic photoconductive drum with a light of a predetermined amplitude to make the surface potential of the organic photoconductive drum as 0 to −100 volts (V).

Preferably, the potential difference between the developing roller and the charged organic photoconductive drum is maintained as −500 volts (V). Preferably, the charging roller is supplied with a charging voltage of −1.4 kilovolts (kV) direct current (DC) so that the toner existing on the organic photoconductive drum and having positive charges is collected, negatively-charged, and transferred to the organic photoconductive drum again.

According to another aspect of the present invention, a method for controlling an electronic photograph forming apparatus including a supplying roller, a developing roller, a charging roller, an organic photoconductive drum, a laser scanning unit (LSU), a transferring roller and a power supply is provided. In the method, the organic photoconductive drum is charged by the charging roller. In order to remove waste toner attached to the transferring roller, the organic photoconductive drum and the transferring roller are raced. According to a predetermined standard, the voltage of the transferring roller is varied. The toner remaining on the organic photoconductive drum and having negative charges is collected onto the developing roller by a potential difference and an electrostatic latent image is formed on the charged organic photoconductive drum by the laser scanning unit. Then, the toner on the developing roller is transferred to the electrostatic latent image on the organic photoconductive drum to form a visible image. After the attached force of the toner to the organic photoconductive drum is reduced to a predetermined level, the visible image is transferred to a print paper.

Preferably, the method for controlling the electronic photograph forming apparatus according to the present invention further includes the step of collecting the toner existing on the surface of the organic photoconductive drum and having positive charges onto the charging roller by the potential difference, negative-changing the collected toner, and transferring the negatively-charged toner to the organic photoconductive drum again.

According to another aspect of the present invention, a method for printing through control of a voltage supplied to a transferring roller in an electronic photograph forming apparatus including a supplying roller, a developing roller, a charging roller, an organic photoconductive drum, a laser scanning unit (LSU), the transferring roller, and a main motor and a power supply for supplying the above components with power is provided. In the method, after the main motor is operated, a lower voltage than the voltage supplied to the organic photoconductive drum is supplied to the transferring roller in order to remove the toner attached to the transferring roller and having negative charges. The resistance between the transferring roller and the organic photoconductive drum is measured. Based on a transferring voltage corresponding to the measured resistance, a higher voltage than the voltage supplied to the organic photoconductive drum is supplied to the transferring roller in order to remove the toner attached to the transferring roller and having positive charges. When the print paper enters the transferring roller, the composite resistance of the print paper, the transferring roller and the organic photoconductive drum is measured. Then, a transferring voltage corresponding to the measured composite resistance is selected. The selected transferring voltage is supplied to the transferring roller to print the image. Thereafter, the toner attached to the transferring roller and having positive/negative charges are removed by racing the transferring roller and the organic photoconductive drum.

To achieve these and other objects in accordance with the principles of the present invention, as embodied and broadly described, the present invention provides an apparatus, comprising: a photoconductive drum; a charging roller being positioned adjacent to said photoconductive drum, said charging roller charging said photoconductive drum with an electrical charge; a laser scanning unit forming an electrostatic latent image on said photoconductive drum corresponding to data; a developing roller supplying toner to said photoconductive drum, the toner received at said electrostatic latent image on said photoconductive drum forming a visible image on said photoconductive drum; a supplying roller supplying toner to said developing roller; a pre-transfer lamp reducing an attached force of the toner attached to 'said photoconductive drum to a predetermined level; a transferring roller transferring toner from said photoconductive drum to a recordable medium to form an image on the recordable medium; a controller varying voltages of said transferring roller according to a predetermined standard, transferring positively charged toner and negatively charged toner from said transferring roller to said photoconductive drum when racing said transferring roller and said photoconductive drum after the image is formed on the recordable medium; and a power supply supplying power to said charging roller, laser scanning unit, transferring roller, developing roller, photoconductive drum, pre-transfer lamp, and controller, said power supply forming a potential difference among said developing roller and said photoconductive drum to collect negatively-charged toner from said photoconductive drum to said developing roller.

To achieve these and other objects in accordance with the principles of the present invention, as embodied and broadly described, the present invention provides a method, comprising: charging a photoconductive drum with a charging roller; racing said photoconductive drum and a transferring roller to remove waste toner attached to said transferring roller; varying a voltage of said transferring roller according to a predetermined standard; collecting negatively charged toner on said photoconductive drum onto a developing roller by a potential difference between a charge of the toner on said photoconductive drum and a charge of said developing roller; forming an electrostatic latent image on said charged photoconductive drum by a laser scanning unit; forming a visible image by transferring toner located around said developing roller to said electrostatic latent image on said photoconductive drum; performing a pre-transfer process reducing a force attaching toner to said photoconductive drum to a predetermined level of attachment force; and transferring toner having said predetermined level of attachment force to a recordable medium.

To achieve these and other objects in accordance with the principles of the present invention, as embodied and broadly described, the present invention provides a method, comprising: printing an image on a recordable medium through a control of a voltage of a transferring roller in an electronic photograph forming device, said device including said transferring roller, a supplying roller, a developing roller receiving toner from said supplying roller, a charging roller, an organic photoconductive drum, a laser scanning unit, a power supply supplying power to said rollers, and a controller, said printing further comprising: supplying said transferring roller with a first voltage lower than a second voltage supplied to said organic photoconductive drum to remove first toner from said transferring roller, said first toner having negative charges; measuring a resistance between said transferring roller and said organic photoconductive drum; providing said transferring roller with a third voltage higher than said second voltage supplied to said organic photoconductive drum based on a transferring voltage corresponding to said measured resistance to remove second toner from said transferring roller, said second toner having positive charges; detecting a composite resistance of said organic photoconductive drum, said transferring roller, and a recordable medium when the recordable medium contacts said transferring roller; selecting a transferring voltage corresponding to said detected composite resistance; applying said selected transferring voltage to said transferring roller; forming an image on the recordable medium with toner received from said organic photoconductive drum; and removing toner attached to said transferring roller and having positive charges and negative charges by racing said transferring roller and said organic photoconductive drum.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

FIG. 2A illustrates the outer periphery of the organic photoconductive drum when charged as −800 volts (V);

FIG. 2B illustrates the outer periphery of the organic photoconductive drum when an electrostatic latent image of −50 V is formed thereon;

FIG. 2C illustrates the outer periphery of the organic photoconductive drum when toner having negative charges is attached to the electrostatic latent image formed on the organic photoconductive drum and a visible image is formed;

FIG. 2D illustrates the outer periphery of the organic photoconductive drum after processed through a preprocess;

FIG. 8 is a table showing transferring voltage values for removing toner attached to the transferring roller and having positive charges, the transferring voltage values obtained by detecting resistance between the transferring roller and the organic photoconductive drum according to an embodiment of the present invention; and FIGS. 9A through 9C are tables showing transferring voltages to be supplied according to a composite resistance according to an embodiment of the present invention.

DETAILED DESCRIPTION OF THE PREFERRED EMBODIMENTS

Figure 1:
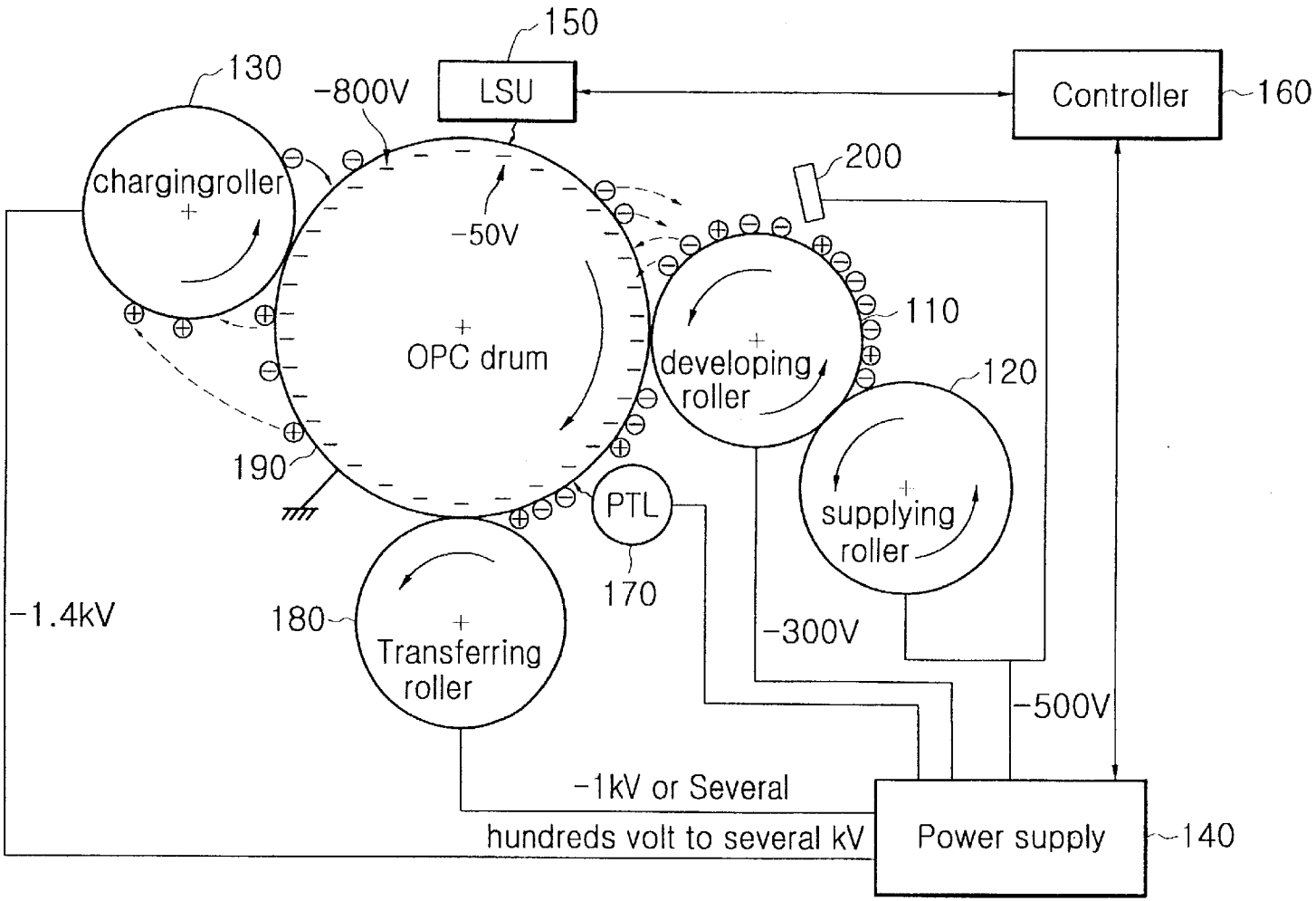
FIG. 1 is a schematic diagram of an electronic photograph forming apparatus, in accordance with the principles of the present invention.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

A laser printer which is one of generally used electronic photograph forming apparatuses includes a charging roller for negative-charging the outer periphery of an organic photoconductive (OPC) drum, and a laser scanning unit (LSU) for forming an electrostatic latent image on the outer periphery of the organic photoconductive drum by emitting a light therefrom. By the charged force of the organic photoconductive drum, toner attached to a developing roller is transferred onto the electrostatic latent image on the organic photoconductive drum so that the electrostatic latent image is changed into a visible image.

The toner attached to the developing roller is charged by a supplying roller and generally has negative charges. However, some of the toner has positive charges due to imbalance of the toner and a heavy stress between the supplying roller and the developing roller.

As described above, the toner attached to the developing roller and having positive/negative charges is transferred to the organic photoconductive drum. The toner having negative charges is transferred to the electrostatic latent image formed on the organic photoconductive drum and forms a visible image by a potential difference. The toner which is not negatively-charged, and which is at least partially positively-charged, is also transferred to the negatively-charged organic photoconductive drum.

The toner moved to the organic photoconductive drum and having positive charges is not transferred to a print paper by a positively-charged transferring roller. The toner moved to the organic photoconductive drum and having positive charges is accumulated around the charging roller.

The toner accumulated around the charging roller and having positive charges obstructs the organic photoconductive drum from being negatively-charged and a background phenomenon wherein the portion which is not negatively-charged is partially changed into black occurs.

As a result, the amount of toner charged and transferred through the developing roller is increased and this phenomenon is continuously repeated. Accordingly, the charging roller becomes significantly and seriously contaminated.

In order to overcome such a contaminated charging roller problem, a toner removing unit for removing the positively-charged toner accumulated around the charging roller is required. Since the negatively-charged toner forming the visible image on the organic photoconductive drum is not entirely transferred to the print paper by the transferring roller, the remaining toner contaminates the outer periphery of the organic photoconductive drum. Therefore, a cleaning blade is further installed to remove the remaining toner.

When the laser printer is raced under the condition that the print paper is not located between the organic photoconductive drum and the transferring roller, the toner having negative charges and existing on the organic photoconductive drum is transferred to the positively-charged transferring roller and the transferring roller is accordingly contaminated. At this time, the back of the print paper may become black. To protect the transferring roller from being contaminated, the laser printer needs a toner removing unit for removing the toner having negative charges and accumulated around the transferring roller.

The above-described laser printer suffers from an increased cost for the additional waste toner removing unit. The above-described laser printer forms a visible image by transferring toner having negative charges to the electrostatic latent image formed on the organic photoconductive drum, and transfers the visible image onto the print paper by supplying the transferring roller with a predetermined amount of voltage. At this time, the toner that forms the visible image on the organic photoconductive drum is attached to the organic photoconductive drum by a uniform force. However, the toner is more strongly attached onto the boundary of a non-visible image by potential difference. Accordingly, when a transferring process is performed, the strongly attached toner is not transferred onto the print paper, which results in deteriorated print quality and increased remaining toner.

The above-described laser printer supplies the transferring roller with a uniform voltage regardless of the resistance of the print paper. Accordingly, the transferring efficiency is lowered and a large capacity of power supply is required.

The above-described laser printer suffers from a problem that the toner is attached to the organic photoconductive drum due to mechanical friction between the charging roller and the organic photoconductive drum caused by a linear velocity difference thereof.

Now, the present invention will now be described more fully hereinafter with reference to the accompanying drawings.

Terminologies used hereinafter are defined in consideration of the functions in the present invention and may be changed according to intents of those skilled in the art or convention. Therefore, the definitions of the terminologies should be made based on the entire contents of the specification of the present invention.

Prior to describing the present invention, the feature of toner will be briefly described. Toner having a negative charge is moved from a lower voltage point to a higher voltage point. Toner having a positive charge is moved from a higher voltage point to a lower voltage point.

An electronic photograph forming apparatus according to the present invention will be described with reference to FIGS. 1 through 3. First, a developing roller 110 is supplied with a voltage of −300 volts (V) from a power supply 140. By friction between the developing roller 110 and a supplying roller 120, toner mostly having negative charges is located on the surface of the developing roller 110. However, the toner having positive charges is also located on the surface of the developing roller 110 due to imbalance of the toner and the heavy stress between the supplying roller 120 and the developing roller 110.

The toner may be one of a pulverization type toner formed by pulverization of a pulverizing machine and a polymerization type toner formed by a chemical technology. A charging portion 130 is formed of a conductive roller having an appropriate resistance. A negative voltage of a predetermined amplitude, for example, a negative voltage of −1.4 kilovolts (kV) is supplied from the power supply 140 to the charging roller 130.

Figure 2A:
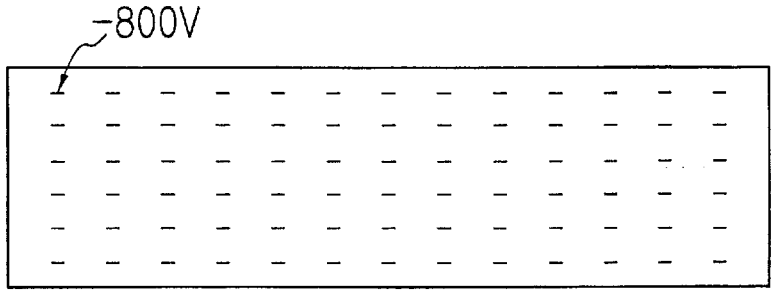
FIGS. 2A through 2D are conceptional views illustrating the states of the outer periphery of an organic photoconductive drum, in accordance with the principles of the present invention.
Figure 2B:
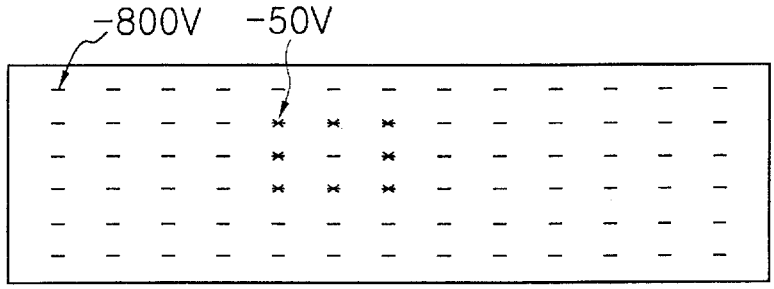

The organic photoconductive (OPC) drum 190 is, as shown in FIG. 2A, charged by friction with the charging roller 130 and a negative potential of −800 V is accordingly formed on the surface of the organic photoconductive drum 190. A laser scanning unit (LSU) 150 supplies the organic photoconductive drum 190 with a light according to the control of a controller 160 so that an electrostatic latent image is formed as shown in FIG. 2B. The potential of the electrostatic latent image formed portion is −50 V and the potential of the portion without the electrostatic latent image formed is −800 V.

Figure 2C:
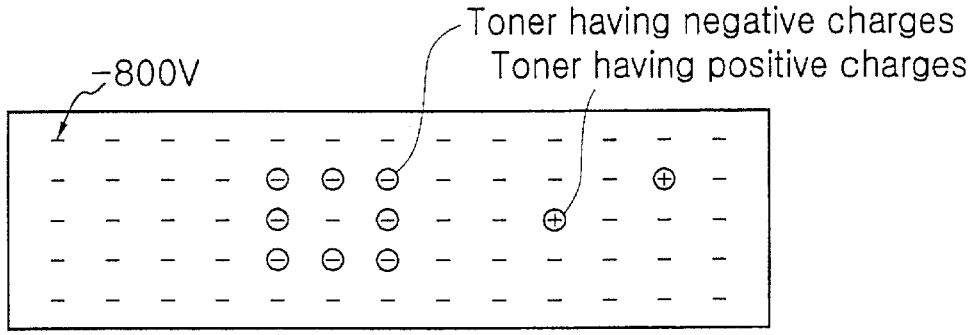

When the organic photoconductive drum with the electrostatic latent image formed thereon is passed by the developing roller 110, the toner on the outer periphery of the developing roller 110 is transferred and attached to the electrostatic latent image portion of the organic photoconductive drum by potential difference. Accordingly, a visible image is formed on the organic photoconductive drum as shown in FIG. 2C.

A pre-transfer lamp (PTL) 170 supplies the organic photoconductive drum 190 with a light of a predetermined amplitude so that the attached force of the toner to the organic photoconductive drum 190 is reduced. Then, the surface potential of the organic photoconductive drum is increased up to zero to −100 volts (V).

Figure 3:
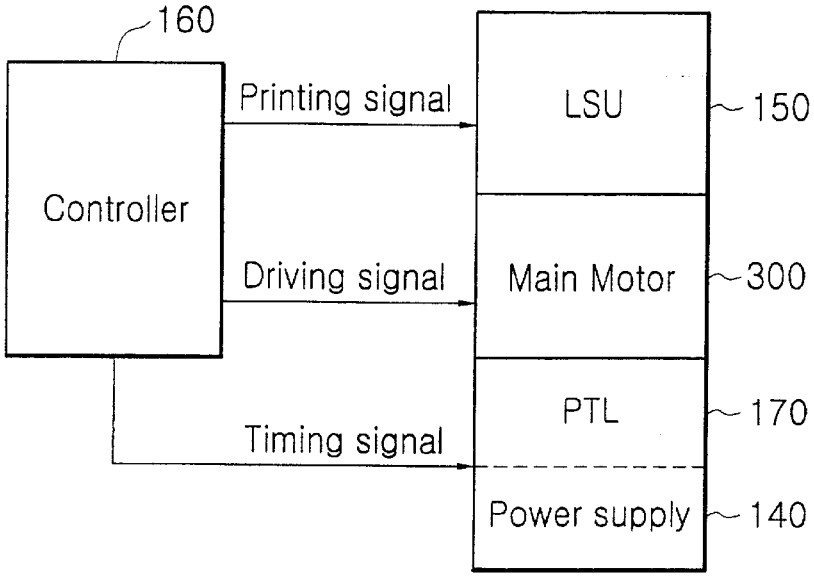
FIG. 3 is a block diagram of an electronic photograph forming apparatus, in accordance with the principles of the present invention.

The pre-transfer lamp 170 is continuously operated according to a timing signal of the controller 160 while a main motor 300 of FIG. 3 operates so that the toner remaining on the organic photoconductive drum can be easily removed when the transferring roller and the organic photoconductive drum are raced. The term "race" indicates a rapid movement. Thus, when the roller and drum are raced, the roller and drum are rotated rapidly.

Figure 2D:
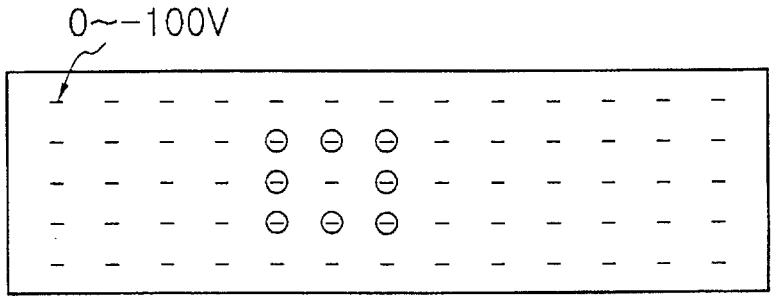

The pre-transfer lamp 170 keeps the surface potential of the organic photoconductive drum 190 uniform as shown in FIG. 2D before a transferring operation is performed so that transferring efficiency of the visible image formed on the organic photoconductive drum 190 can be improved.

As an embodiment of the present invention, the pre-transfer lamp 170 applies a light of a predetermined amplitude to the outer periphery of the organic photoconductive drum 190 to make the surface potential of the organic photoconductive drum 190 as zero to −100 V.

A blade 200 evenly spreads the toner supplied to the developing roller 110 and the power supply 140 supplies the blade 200 and the supplying roller 120 with the same voltage, for example, −500 V, to attempt to obtain an evenly coated, and evenly charged, toner layer.

In order to transfer waste toner attached to a transferring roller 180 to the organic photoconductive drum 190 and recollect the waste toner through the developing roller 110 while the organic photoconductive drum 190 and the transferring roller 180 are raced, the controller 160 varies voltage of the transferring roller 180 as follows.

In other words, in order to transfer the toner attached to the transferring roller 180 and having negative charges to the organic photoconductive drum 190, a lower voltage than the voltage supplied to the organic photoconductive drum 190, for example, −1 kilovolts (kV) is supplied to the transferring roller 180, and in order to transfer the toner attached to the transferring roller 180 and having positive charges to the organic photoconductive drum 190, a higher voltage than the voltage supplied to the organic photoconductive drum 190, for example, 800 V is supplied to the transferring roller.

The controller 160 varies the voltage of the transferring roller 180 according to the resistance of the print paper entering the transferring roller 180. Preferably, the speeds of the charging roller 130 and the organic photoconductive (OPC) drum 190 are structured in the ratio of one to one. Accordingly, it is possible to prevent the toner passed through the space between the charging roller 130 and the organic photoconductive drum 190 from being coated on the outer periphery of the organic photoconductive drum 190 by mechanical friction in the event that the speed ratio is not maintained as one to one.

Figure 4:
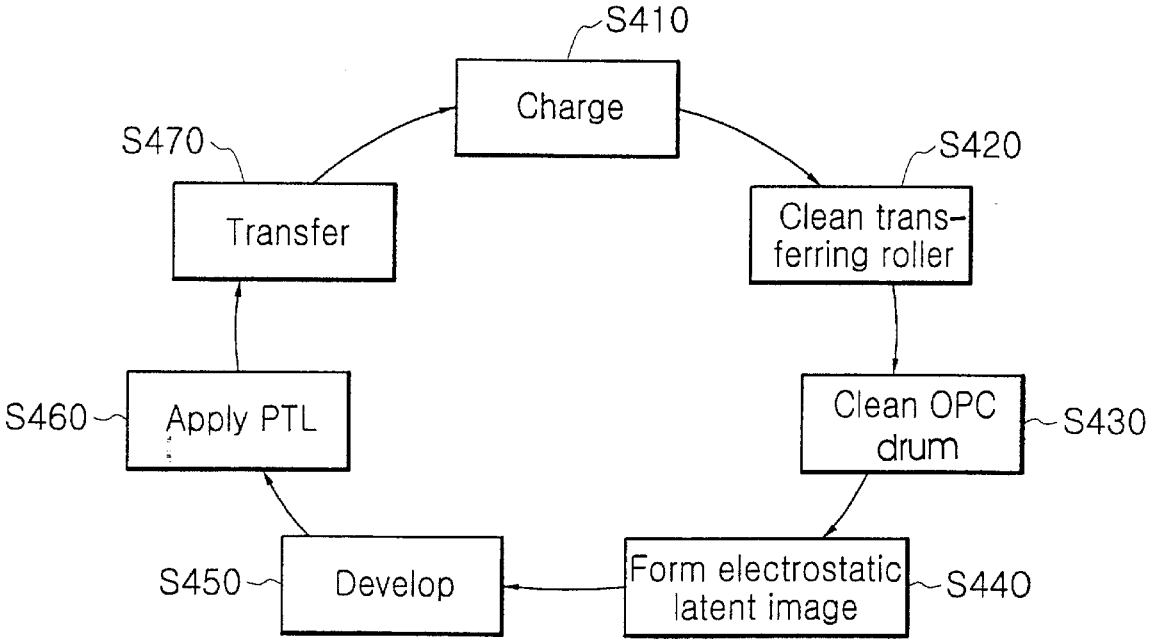
FIG. 4 illustrates a controlling method of the electronic photograph forming apparatus, in accordance with the principles of the present invention.
Figure 5:
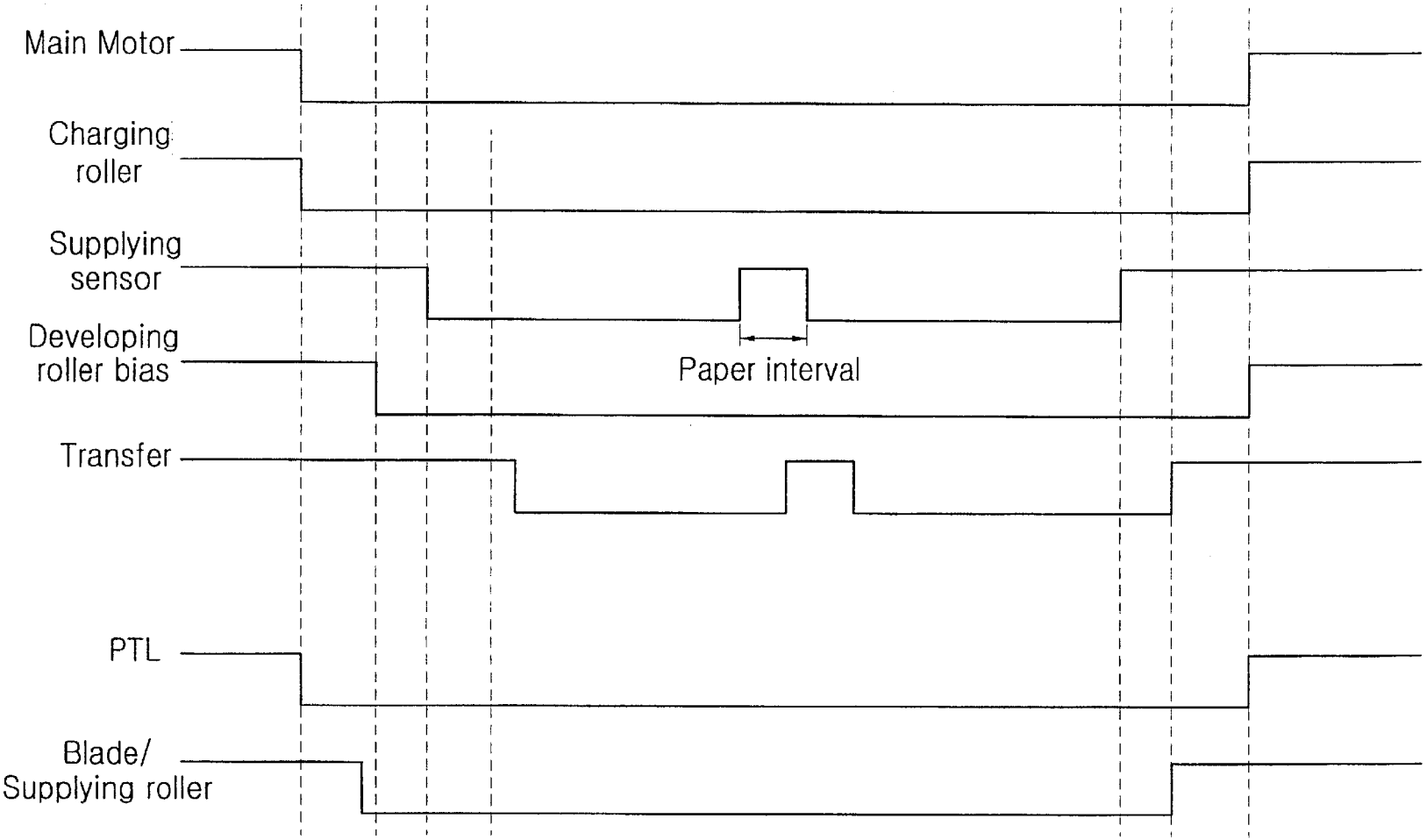
FIG. 5 is a timing chart of controlling the operations of respective components of the electronic photograph forming apparatus, in accordance with the principles of the present invention.

A method for controlling the electronic photograph forming apparatus according to the present invention will be described with reference to FIGS. 4 to 5. First, the controller 160 operates the main motor 300 to charge the organic photoconductive drum 190 by means of the charging roller 130 (S410).

After the organic photoconductive drum 190 is charged, the organic photoconductive drum 190 and the transferring roller 180 are raced to remove waste toner attached to the transferring roller 180. As described above, the voltage of the transferring roller 180 is varied (S420).

Then, the toner remaining on the organic photoconductive drum 190 and having negative charges is collected to the developing roller 110 by potential difference (S430). On the other hand, the charging roller 130 supplied with a voltage of −1.4 kV collects the toner existing on the organic photoconductive drum 190 and having positive charges, negatively-charges the collected toner, and transfers the negatively-charged toner to the organic photoconductive drum 190 again to allow the developing roller 110 to collect the toner.

After the toner remaining on the organic photoconductive drum 190 and the transferring roller 180 is removed, an electrostatic latent image is formed on the charged organic photoconductive drum 190 by the laser scanning unit 150 (S440).

The controller 160 senses through a supplying sensor (not shown) that a print paper is fed and supplies the supplying roller 120 and the blade 200 with power to form an evenly applied toner layer on the developing roller 110.

After the electrostatic latent image is formed on the organic photoconductive drum 190, the organic photoconductive drum 190 transfers the toner on the developing roller 110 to the electrostatic latent image by potential difference so that a visible image is formed (S450).

After the visible image is formed on the organic photoconductive drum 190, the pre-transfer lamp 170 applies a light to the entire surface of the organic photoconductive drum 190 to make the surface potential of the organic photoconductive drum as zero to −100 V. Thereby, the attached force of the toner onto the organic photoconductive drum 190 is reduced (S460).

As described above, in lowering the transferring voltage by reducing the attached force of the toner to the organic photoconductive drum 190, the relation between the attached force F1 of the toner to the organic photoconductive drum 190, and the transferring force F2 required to transfer the toner from the organic photoconductive drum 190 to the print paper is applied.

In other words, since the transferring force F2 should satisfy the condition of F2>F1, the transferring force F2 can be reduced by reducing the attached force F1. In this manner, the transferring voltage can be lowered.

When the attached force F1 of the toner to the organic photoconductive drum 190 is excessively reduced, cohesion of the toner is reduced and the image is inaccurately spread. Therefore, an optimal toner cohesion for obtaining an optimal image is obtained through tests. Based on the obtained optimal toner cohesion, the pre-transfer lamp 170 applies a light to the organic photoconductive drum 190.

When the visible image of the organic photoconductive drum 190 is passed by the pre-transfer transfer lamp 170 and arrives at the transferring roller 180, the controller 160 controls the main motor 300 to insert the print paper into the transferring roller 180. When the print paper enters the transferring roller 180, voltages having various values are supplied according to the resistance of the print paper so that an optimal image can be obtained (S470). At this time, in the case that the voltage is not appropriately supplied according to the resistance of the print paper, the transferring efficiency can be deteriorated and accordingly a poor quality image may be produced on the print paper.

The transferring roller 180 conveys the recordable medium, such as a sheet of print paper, to the visible image formed by the toner on the photoconductive drum 190. The print paper passed by the transferring roller is transferred to a fixing unit (not shown) with the toner separated from the organic photoconductive drum 190 thereon. After the print paper is passed by the transferring roller 180, some of the toner remaining on the organic photoconductive drum 190 has positive charges and the other has negative charges.

While the toner is passed by the charging roller 130, the toner having the positive charges is transferred to the charging roller 130 and the toner having the negative charges is transferred to the developing roller 110. The positive charges of the toner transferred to the charging roller 130 are changed into negative charges on the charging roller 130. The toner having the changed negative charges is transferred to the developing roller 110 through the organic photoconductive drum 190.

When transferred to the developing roller 110, the toner having the negative charges on the non-image portion of the organic photoconductive drum 190 is collected to the developing roller 110 by difference between the potential of the non-image portion of the organic photoconductive drum 190, for example, −800 V, and the potential of the developing roller 110, for example −300 V. Accordingly, it is possible to prevent the background of the non-image portion from being deteriorated and thereby obtain a good quality image.

Preferably, in order to obtain a high collecting efficiency while the toner having negative charges of the non-image portion is collected onto the developing roller 110, the voltages supplied to the charging roller and the developing roller are set up as −1.4 kV and −300 V, respectively. Thereby, a good quality image can be obtained.

The controller 160 races the organic photoconductive drum 190 and the transferring roller 180 and varies the voltage of the transferring roller 180 to remove waste toner attached to the transferring roller 180. In other words, the controller 160 causes the organic photoconductive drum 190 and the transferring roller 180 to rotate rapidly, and the controller 160 varies the voltage of the transferring roller 180 to remove waste toner attached to the transferring roller 180.

Figure 6:
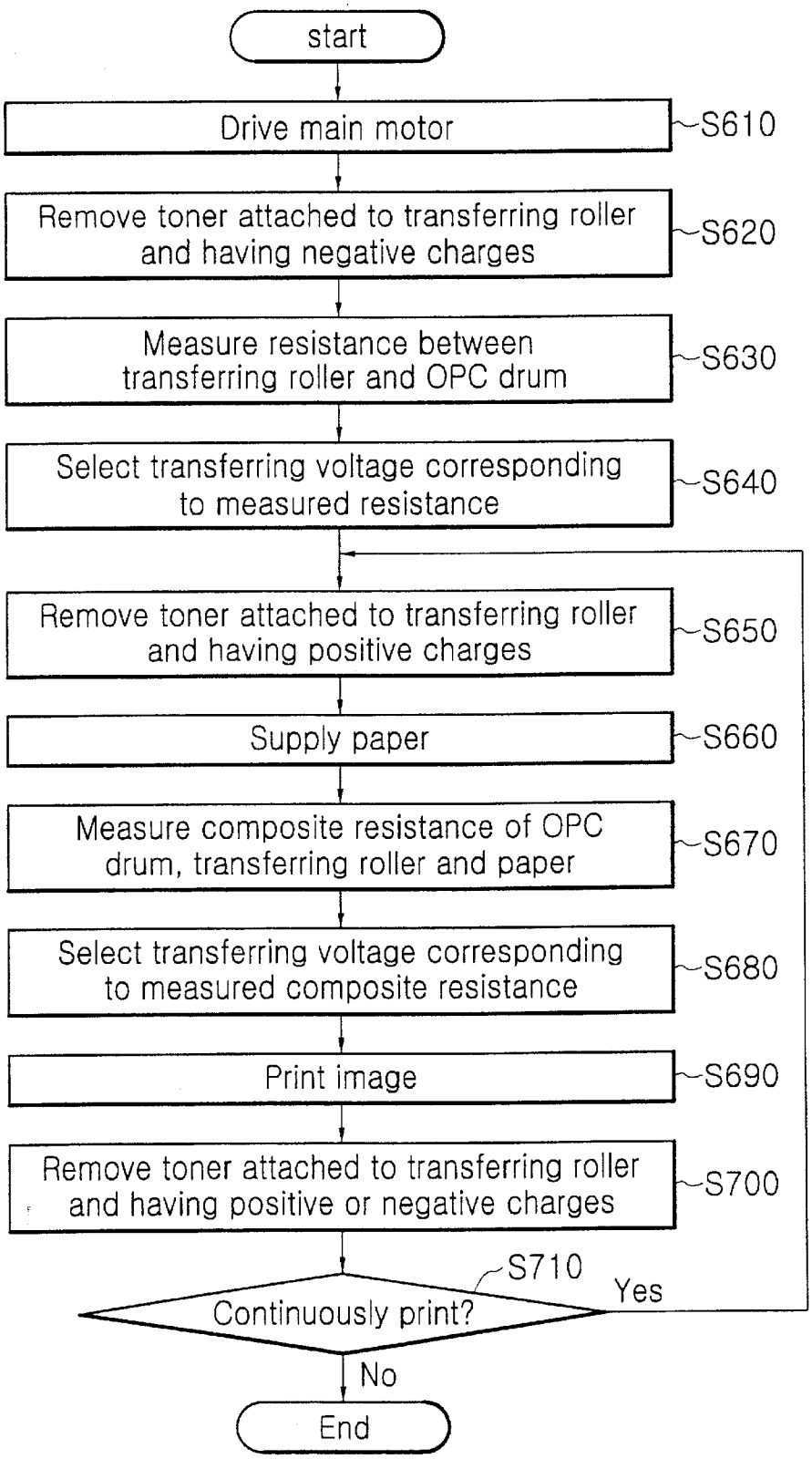
FIG. 6 is a flow chart of a method for printing through control of a voltage supplied to a transferring roller, in accordance with the principles of the present invention.
Figure 7:
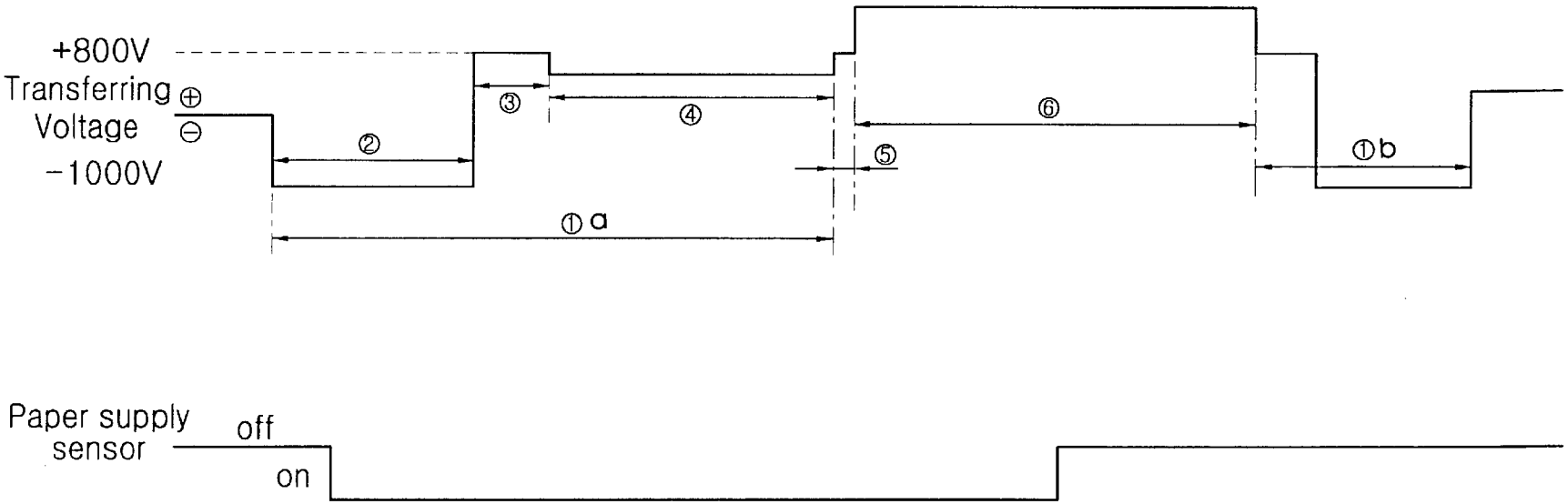
FIG. 7 is a timing chart showing different voltages of the transferring roller at different times during a printing process, in accordance with the principles of the present invention.

Referring to FIGS. 6 and 7, the method for printing through control of the transferring roller 180 will be described. First, the controller 160 drives the main motor 300 (S610). After the main motor 300 is driven, the organic photoconductive drum 190 and the transferring roller 180 are raced in part ①*a* of FIG. 7 and the toner having positive/negative charges is removed as follows.

First, a lower voltage, for example, −1000 volts, which is lower than a potential formed on the outer periphery of the organic photoconductive drum 190 is supplied to the transferring roller 180 so that the toner attached to the transferring roller 180 and having negative charges is transferred to the organic photoconductive drum 190. The toner transferred to the organic photoconductive drum 190 and having negative charges is collected onto the developing roller through the charging roller 130. At this time, the toner remaining on the organic photoconductive drum 190 and having 9 positive charges is transferred to the transferring roller 180 (S620, part ② of FIG. 7).

A specific voltage is supplied to the transferring roller 180 before the print paper arrives at the transferring roller 180. The current flowing through the transferring roller 180 is measured to sense the resistance between the transferring roller 180 and the organic photoconductive drum 190. In this manner, the condition under which the engine is presently used is recognized (S630, part ③ of FIG. 7).

In other words, if a voltage of 800 volts (V) is supplied to the transferring roller 180 and the 6 current flowing through the transferring roller 180 is 4 microamps ($\mu$A), the resistance between the transferring roller 180 and the organic photoconductive drum 190 is 200 megohms (MΩ) according to Ohm's law. Thus, in accordance with Ohm's law, (800 volts/($4*10^{-6}$ Ω)) 200 megohms. One megohm (MΩ) is equal to one million ohms (i).

After the resistance between the transferring roller and the organic photoconductive drum is measured, a higher voltage than a voltage supplied to the organic photoconductive drum 190 is supplied to the transferring roller based on an appropriate transferring voltage corresponding to the measured resistance so that the toner attached to the transferring roller and having positive charges is transferred to the organic photoconductive drum 190 (S640 and S650, part ④ of FIG. 7).

Preferably, the appropriate transferring voltage with respect to the measured resistance is obtained through tests and stored in the controller 160 as shown in FIG. 8. Thereafter, the controller 160 is supplied with a print paper through a paper supply terminal (S660).

When the supplied print paper is located between the transferring roller 180 and the organic photoconductive drum 190, a specific voltage is supplied in the same manner as step S630 and the composite resistance of the organic photoconductive drum, the transferring roller and the print paper is measured (S670, part ⑤ of FIG. 7).

Then, the controller 160 selects a transferring voltage corresponding to the measured composite resistance (S680). Preferably, the transferring voltage for an optimal image and transferring efficiency with respect to the measured composite resistance is obtained through tests and stored in the controller 160 as shown in FIGS. 9A through 9C.

After the transferring voltage corresponding to the measured composite resistance is selected, the controller 160 controls the power supply 140 so that the selected transferring voltage is supplied to the transferring roller 180 and the image is printed. (S690, part ⑥ of FIG. 7).

Part ⑥ is until the bottom end of the print paper is passed by the transferring roller 180 and the print paper passed by the transferring roller 180 is output through the fixing unit (not shown). While the print paper is output through the fixing unit, the transferring roller 180 and the organic photoconductive drum 190 are raced and the toner is removed from the outer periphery of the transferring roller (S700, part ①*b* of FIG. 7).

Preferably, the toner is removed in such a manner that the toner having positive charges is firstly transferred to the organic photoconductive drum 190 and the toner having negative charges is then transferred. The process is returned to step S650 to perform the printing process continuously (S710).

As described above, the present invention provides advantages as follows. First, waste toner can be entirely removed without using a waste toner removing unit. By varying the surface potential of the organic photoconductive drum before the toner developed on the organic photoconductive drum enters the transferring roller, the transferring efficiency can be improved and accordingly good quality image can be obtained. By varying the voltage supplied to the transferring roller according to the resistance of the print paper, a high transferring efficiency can be obtained with a small capacity of power supply.

In addition, the part where the transferring roller and the organic photoconductive drum are raced is used as a cleaning part for cleaning the transferring roller and the organic photoconductive drum, whereby waste toner generation can be suppressed and good quality image can be obtained. Moreover, the toner can be prevented from being attached to the organic photoconductive drum due to the mechanical friction between the charging roller and the organic photoconductive drum and remaining toner collecting efficiency can be increased by appropriately adjusting the potential difference between the charging voltage and the developing voltage.

This invention has been described above with reference to the aforementioned embodiments. It is evident, however, that may alternatives, modifications and variations will be apparent to those having skill in the art in light of the foregoing description. Accordingly, the present invention embraces all such alternatives, modifications and variations as fall within the spirit and scope of the appended claims and their equivalents.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An apparatus, comprising:

a photoconductive drum;

a charging roller being positioned adjacent to said photoconductive drum, said charging roller charging said photoconductive drum with an electrical charge;

a laser scanning unit forming an electrostatic latent image on said photoconductive drum corresponding to data;

a developing roller supplying toner to said photoconductive drum, the toner received at said electrostatic latent image on said photoconductive drum forming a visible image on said photoconductive drum;

a supplying roller supplying toner to said developing roller;

a pre-transfer lamp reducing an attached force of the toner attached to said photoconductive drum to a predetermined level;

a transferring roller transferring toner from said photoconductive drum to a recordable medium to form an image on the recordable medium;

a controller varying voltages of said transferring roller according to a predetermined standard, transferring positively charged toner and negatively charged toner from said transferring roller to said photoconductive drum when racing said transferring roller and said photoconductive drum after the image is formed on the recordable medium; and a power supply supplying power to said charging roller, laser scanning unit, transferring roller, developing roller, photoconductive drum, pre-transfer lamp, and controller, said power supply forming a potential difference among said developing roller and said photoconductive drum to collect negatively-charged toner from said photoconductive drum to said developing roller.

2. The apparatus of claim 1, said power supply supplying a first voltage to said transferring roller to transfer negatively charged toner attached to said transferring roller from said transferring roller to said photoconductive drum, in accordance with said predetermined standard, said first voltage being lower than a second voltage supplied to said photoconductive drum.

3. The apparatus of claim 2, said power supply supplying a third voltage to said transferring roller to transfer positively charged toner attached to said transferring roller from said transferring roller to said photoconductive drum, in accordance with said predetermined standard, said third voltage being higher than said second voltage supplied to said photoconductive drum.

4. The apparatus of claim 1, said controller varying a voltage of said transferring roller according to a resistance of the recordable medium.

5. The apparatus of claim 1, further comprising a blade being adjacent to said developing roller, said blade spreading toner supplied to said developing roller, said blade being supplied with a voltage corresponding to a voltage being supplied to said supplying roller.

6. The apparatus of claim 5, the toner spread by said blade being evenly spread.

7. The apparatus of claim 5, the toner spread by said blade being evenly charged.

8. The apparatus of claim 1, a rotational speed of said charging roller being substantially equal to a rotational speed of said photoconductive drum.

9. The apparatus of claim 1, wherein the toner is selected from the group consisting of a pulverization type toner and a polymerization type toner.

10. The apparatus of claim 1, said pre-transfer lamp applying a light so that a surface potential of said photoconductive drum is zero to −100 volts.

11. The apparatus of claim 1, said power supply maintaining said potential difference between said developing roller and said photoconductive drum at −500 volts.

12. The apparatus of claim 1, said power supply supplying said charging roller with a charging voltage of −1.4 kilovolts to collect positively charged toner existing on said photoconductive drum, said charging roller changing positively charged toner to negatively charged toner, said charging roller transferring the negatively charged toner to said photoconductive drum.

13. The apparatus of claim 1, said racing of said transferring roller and said photoconductive drum corresponding to rapidly rotating said transferring roller and said photoconductive drum.

14. The apparatus of claim 13, said power supply forming a first voltage at said photoconductive drum and a second voltage at said transferring roller according to said predetermined standard to transfer positively charged waste toner from said transferring roller to said photoconductive drum, when racing said photoconductive drum and said transferring roller, said first voltage being lower than said second voltage.

15. The apparatus of claim 14, the waste toner corresponding to toner not transferred to the recordable medium.

16. The apparatus of claim 14, said power supply forming a third voltage at said photoconductive drum and a fourth voltage at said transferring roller according to said predetermined standard to transfer negatively charged toner from said transferring roller to said photoconductive drum, when racing said photoconductive drum and said transferring roller, said third voltage being higher than said fourth voltage.

17. The apparatus of claim 16, the waste toner corresponding to toner not transferred to the recordable medium.

18. The apparatus of claim 16, said power supply forming a fifth voltage at said photoconductive drum and a sixth voltage at said charging roller to transfer positively charged toner from said photoconductive drum to said charging roller.

19. The apparatus of claim 18, said charging roller transferring negatively charged toner to said photoconductive drum.

20. The apparatus of claim 13, said controller varying voltages of said transferring roller according to said predetermined standard, transferring positively charged waste toner and negatively charged waste toner from said transferring roller to said photoconductive drum when racing said transferring roller and said photoconductive drum before the image is formed on the recordable medium.

21. The apparatus of claim 20, the waste toner corresponding to toner not transferred to the recordable medium.

22. A method of printing, comprising:

supplying a transferring roller with a first voltage lower than a second voltage supplied to a photoconductive drum to remove first toner from said transferring roller, said first toner having negative charges;

measuring a resistance between said transferring roller and said photoconductive drum;

supplying said transferring roller with a third voltage higher than said second voltage supplied to said photoconductive drum based on a transferring voltage corresponding to said measured resistance to remove second toner from said transferring roller, said second toner having positive charges;

forming an electrostatic latent image on said photoconductive drum by a laser scanning unit;

forming a visible image by transferring toner located around a developing roller to said electrostatic latent image on said photoconductive drum;

performing a pre-transfer process reducing a force attaching toner to said photoconductive drum to a predetermined level of attachment force; and transferring toner having said predetermined level of attachment force to a recordable medium.

23. The method of claim 22, said supplying of said first and third voltages to said transferring roller being performed in accordance with a predetermined standard.

24. The method of claim 22, further comprising racing said photoconductive drum and said transferring roller to remove said first and second toner from said transferring roller.

25. A method, comprising:

printing an image on a recordable medium through a control of a voltage of a transferring roller in an electronic photograph forming device, said device including said transferring roller, a supplying roller, a developing roller receiving toner from said supplying roller, a charging roller, an organic photoconductive drum, a laser scanning unit, a power supply supplying power to said rollers, and a controller, said printing further comprising:

supplying said transferring roller with a first voltage lower than a second voltage supplied to said organic photoconductive drum to remove first toner from said transferring roller, said first toner having negative charges;

measuring a resistance between said transferring roller and said organic photoconductive drum;

providing said transferring roller with a third voltage higher than said second voltage supplied to said organic photoconductive drum based on a transferring voltage corresponding to said measured resistance to remove second toner from said transferring roller, said second toner having positive charges;

detecting a composite resistance of said organic photoconductive drum, said transferring roller, and a recordable medium when the recordable medium contacts said transferring roller;

selecting a transferring voltage corresponding to said detected composite resistance;

applying said selected transferring voltage to said transferring roller;

forming an image on the recordable medium with toner received from said organic photoconductive drum; and removing toner attached to said transferring roller and having positive charges and negative charges by racing said transferring roller and said organic photoconductive drum.

26. The method of claim 25, said measuring, providing, detecting, selecting, applying, forming, and removing being repeated to continuously print.

* * * * *